US008471160B1

(12) United States Patent
Beugelsdyk et al.

(10) Patent No.: US 8,471,160 B1
(45) Date of Patent: Jun. 25, 2013

(54) INLINE CONDUIT SWITCH

(75) Inventors: Anthony F. Beugelsdyk, Wichita, KS (US); Daniel D. Clarke, Mount Hope, KS (US)

(73) Assignee: Wescon Products Company, Wichita, KS (US)

( * ) Notice: Subject to any disclaimer, the term of this patent is extended or adjusted under 35 U.S.C. 154(b) by 478 days.

(21) Appl. No.: 12/835,643

(22) Filed: Jul. 13, 2010

Related U.S. Application Data

(60) Provisional application No. 61/229,095, filed on Jul. 28, 2009.

(51) Int. Cl.
*H01H 1/50* (2006.01)

(52) U.S. Cl.
USPC ..... 200/250

(58) Field of Classification Search
USPC ..... 200/237–239, 250, 534, 535, 543, 200/61.13–61.18
See application file for complete search history.

(56) References Cited

U.S. PATENT DOCUMENTS 4,681,994 A * 7/1987 Nagata et al. ..... 200/16 B
2007/0199813 A1* 8/2007 Nakade et al. ..... 200/329

OTHER PUBLICATIONS

Photograph showing a switch made by Wescon Products Company which is conceded to be prior art. The switch shown in the photograph is a low force, momentary switch actuated by cable tension from an inline cable and used to indicate operation of a cruise control for a motorcycle throttle. The switch includes a neoprene plate which is positioned between the electrical contacts and compressed under tension applied to the cable.

* cited by examiner

*Primary Examiner* — Renee Luebke
*Assistant Examiner* — Lheiren Mae Caroc
(74) *Attorney, Agent, or Firm* — Hovey Williams LLP

(57) ABSTRACT

An inline conduit switch includes a body having an anchor fitting adapted for mounting to a support and a conduit fitting adapted for mounting a control cable thereto. The conduit fitting is at least partially received in a bore of the anchor fitting for relative axial movement between a first configuration to which the body is normally biased and a second, compressed configuration. First and second electrical contacts are operatively carried by the anchor fitting and the conduit fitting, and are brought into electrically conductive engagement in the second configuration. The inline conduit switch operates to create electrical contact when a control cable is placed in tension, thereby axially shifting the conduit fitting relative to the anchor fitting.

14 Claims, 7 Drawing Sheets

INLINE CONDUIT SWITCH

This application claims the benefit of U.S. Provisional Patent Application Ser. No. 61/229,095 filed Jul. 28, 2009

BACKGROUND OF THE INVENTION

1. Field of the Invention

The present invention is concerned with an electrical switch which is located in line with a control cable, whereby application of tension to an inner core forming a part of the control cable brings electrical contacts into engagement for actuation of the switch. More particularly, it is concerned with an inline conduit switch which prevents overstressing of the contacts and isolates them from the surrounding environment.

2. Description of the Prior Art

Control cables are well known to those skilled in the art and as used herein, such control cables include a inner core typically of wire and a surrounding protective conduit or sheath. Their use is well known in a variety of applications such as fork lifts, utility vehicles, automobiles and light trucks, and lawn mowers and other powered equipment. The inner core of the control cable is able to shift within the conduit or sheath to actuate a controllable device. Such controllable devices may include, for example, a handbrake, a power takeoff mechanism, a drive engagement, or any other of a number of different devices which are intended to be manually actuated by a control cable. One end of the control cable is connected to a manually actuated control, for example a push-pull control, button, or lever, and the other to the device to be operated. Manually engaging the control exerts a tensioning force on the inner core, which in turn actuates the controllable device.

In many instances, it is desired to have an electrical function be carried out simultaneously with the manual actuation. For example, it may be useful for the operator to have a light, such as an indicator light, illuminate to show and confirm that the control has been actuated and that the controllable device is and remains engaged. Heretofore, this electrical operation has typically been carried out by an electrical microswitch operated by the control mechanism. Such microswitches, however, have a number of drawbacks. They are relatively expensive, must be separately installed on the control mechanism, are subject to fouling when used in muddy or other hostile environments, and may provide a false indication of operation. In regard to this latter condition, such microswitches mounted to control mechanisms may show that, for example, the handbrake has been applied and is operating, when in fact the control cable is broken and no tension is being applied to actuate the controllable mechanism.

Another switch has heretofore been developed which is positioned in line with the control cable, but this switch is not designed for rugged environments, and is designed as a low force momentary switch. While useful in such applications, it does not function as a conduit guide, is not sealed against the entry of external contaminants such as mud, and requires a biasing member be located between the contacts to maintain their separation until desired. Further, the aforementioned switch was developed for light duty applications with little conduit support, such that it is subject to damage in heavy duty environments where any significant transverse deflection of the conduit occurs.

Thus, there is a need for an improved inline conduit switch which overcomes these drawbacks with existing microswitches and the aforementioned inline switch, and also provides additional improvements.

SUMMARY OF THE INVENTION

These and other objects are largely met by the inline conduit switch of the present invention. That is to say, the inline conduit switch of the present invention is configured to isolate the electrical contacts within the switch from interference or contamination by external elements.

Moreover, the inline conduit switch of the present invention is more economical than utilizing currently available microswitches because it is designed to function as a conduit guide at one end of the control conduit.

Also, the inline conduit switch of the present invention avoids the problem of a false actuation light, as breakage or slippage of the inner core along the length of the conduit interrupts the application of tension to the inner core and a corresponding compression of the sheath to close the electrical contacts of the switch.

Further, the inline conduit switch of the present invention is designed for long-term cable tensioning, by preventing spring overloading within the switch and most preferably also providing deflecting biasing elements in the form of leaf spring contact prongs as a part of at least one of the electrical contacts.

In addition, the inline conduit switch of the present invention is designed to provide a relatively long length of control cable support within the switch, thereby permitting significant deflection of the control cable without consequent damage to either the control cable or the inline conduit switch.

Yet further, the inline conduit switch of the present invention in its most preferable embodiments permits rotating movement of the control cable while maintaining relative alignment between the electrical contacts, thereby substantially eliminating torque loading which would damage a flexible weather cover used in sealing the electrical contacts from external contaminants.

Broadly speaking, the inline conduit switch of the present invention includes an anchor fitting adapted for mounting to a bracket or other support, a conduit fitting at least partially received within the anchor fitting and adapted for receiving therein and supporting a control cable, a biasing member operatively positioned between the anchor fitting and the conduit fitting for applying an axially directed biasing force therebetween, a pair of axially spaced electrical contacts which are configured and positioned for relative shifting movement concomitant with axial movement between the anchor fitting and the conduit fitting, an insulating assembly for preventing electrical communication between the electrical contacts until desired, and a sealing assembly for inhibiting entry of moisture and environmental contaminants to the portion of the electrical contacts lying interiorly of the sealing assembly. In preferred embodiments, the inline conduit switch hereof further includes a retainer for retaining the conduit fitting in a partially inserted position within the anchor fitting and preventing unintended separation.

Those skilled in the art will appreciate the achievement of the foregoing advantages with reference to the description which follows and the accompanying drawings, wherein:

DESCRIPTION OF THE PREFERRED EMBODIMENT

Figure 1:
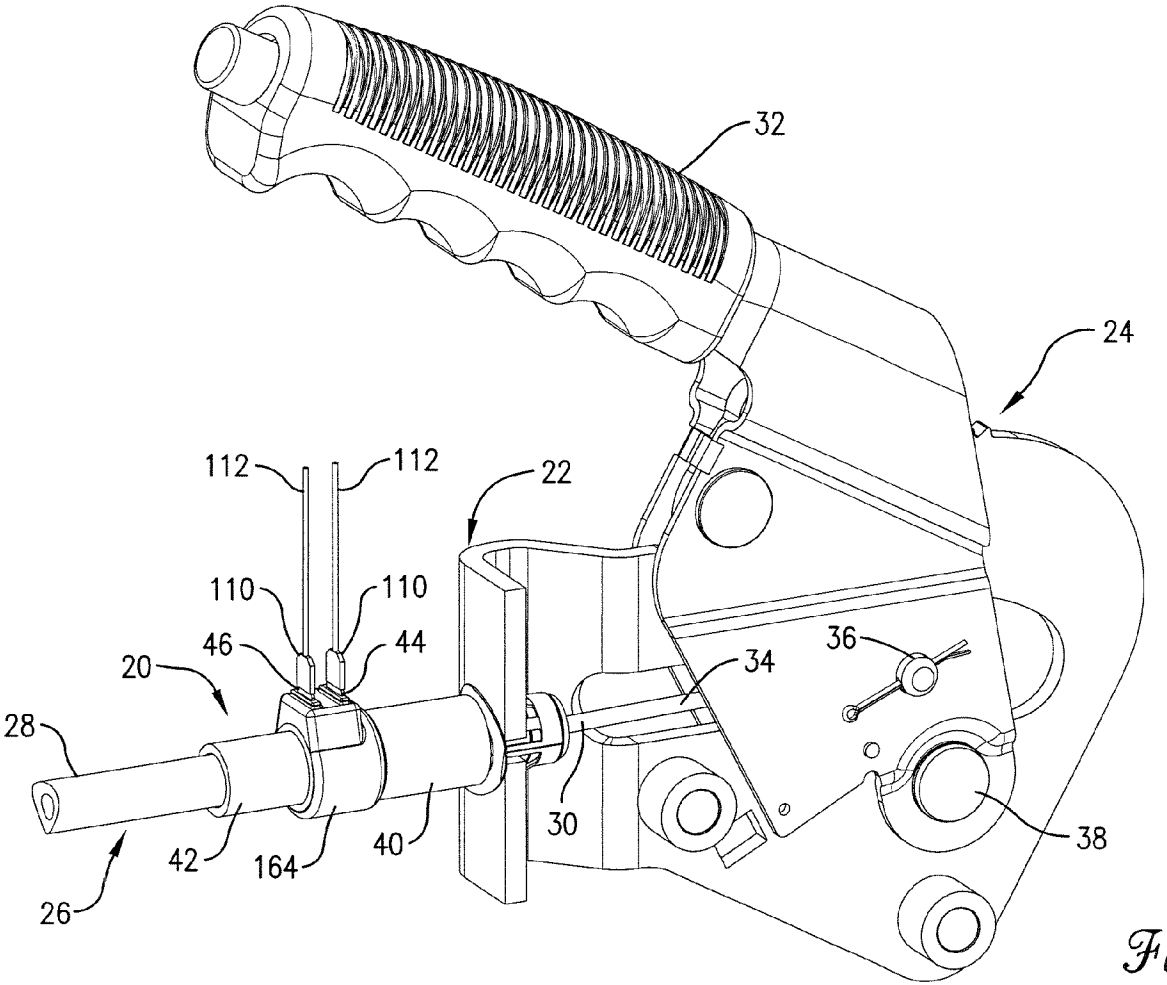
FIG. 1 is an isometric view showing an inline conduit switch coupled to a mounting brake of a lever control mechanism and electrical leads attached to the electrical contacts of the switch.

Referring now to the drawings, an inline conduit switch 20 is shown in FIG. 1 mounted to a support bracket 22 of a control assembly 24. A portion of a control cable 26 having a sheath 28 and an inner core 30 is shown mounted to the inline conduit switch 20, which in addition to its electrical switch capabilities also functions as a conduit guide. The remote end (not shown) of the control cable 26 is mounted in a remote location with the remote end of the sheath 28 mounted to another support bracket and the remote end of the inner core 30 operatively connected to an cable-actuatable device such as, for example, a brake assembly or power take-off unit, but it is to be appreciated that other devices which are actuatable or shiftable (e.g. flaps, doors, etc.) could also be connected to the remote end of the inner core as is well known in the art.

The control assembly 24 is shown in FIG. 1 as a having a lever 32 pivotally mounted to the support bracket 22, with the proximate end 34 of the inner core 30 fixed to the lever 32 (here accomplished by coupling pin 36). As the lever 32 pivots about pivot pin 38 pivotally connecting the lever 32 to the support bracket 22, the inner core 30, the inner core 30 shifts within sheath 28 and the inner core 30 is placed in tension. At the same time, because the proximate and remote ends of the sheath 28 are constrained, the sheath 28 is placed in compression when the lever 32 places the inner core 30 in tension. Control assemblies 24 such as push-pull and other types placing the inner core 30 in tension and the sheath 28 in compression may also be used as will be appreciated by those skilled in the art.

The inline conduit switch 20 is shown in greater detail in FIGS. 2 through 13 and broadly includes an anchor fitting 40 adapted for mounting to the support bracket 22, a conduit fitting 42 interfitting with and at least partially received within the anchor fitting 40, first and second axially spaced electrical contacts 44 and 46 configured and positioned for relative shifting movement concomitant with axial movement between the anchor fitting and the conduit fitting, a biasing member 48 operatively positioned between the anchor fitting 40 and the conduit fitting 42 for applying an axially directed biasing force therebetween, an insulating assembly 50 for preventing electrical connection between the electrical contacts 44 and 46 until desired, and a sealing assembly 52 for inhibiting entry of moisture and environmental contaminants to the portion of the electrical contacts 44 and 46 lying interiorly of the sealing assembly 52. The preferred inline conduit switch 20 hereof further includes a retainer 54 for retaining the conduit fitting 42 in a partially inserted position within the anchor fitting 40 and preventing unintended separation.

Figure 2:
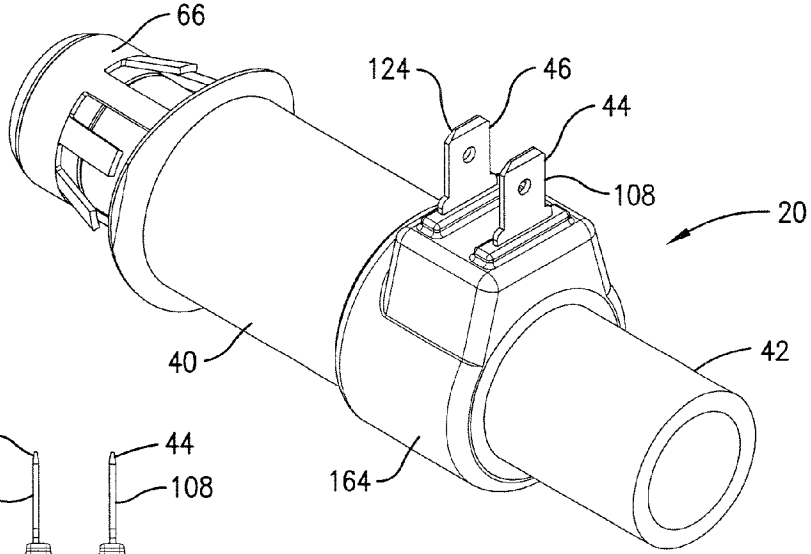
FIG. 2 is a right front isometric view of the inline conduit switch of FIG. 1 in an unmounted condition, showing the conduit fitting connected to the anchor fitting with a flexible weather cover enclosing the engagement area of the electrical contacts.
Figure 3:
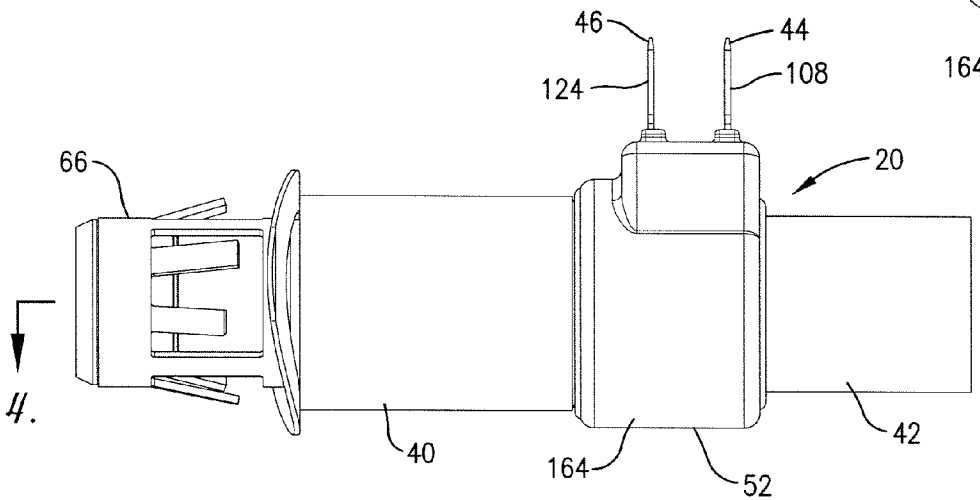
FIG. 3 is a front elevation view of the inline conduit switch of FIG. 1 provided with a snap-in mounting clip for attaching the anchor fitting to a support.
Figure 4:
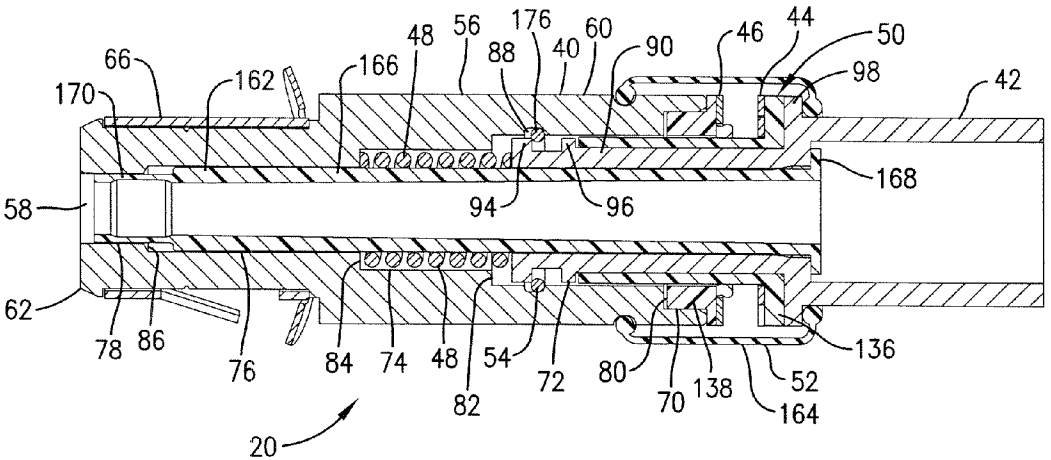
FIG. 4 is a horizontal cross-sectional view taken along line 4-4 of FIG. 3 through the inline conduit switch shown in FIG. 1, showing the anchor fitting, biasing spring, internal seal, conduit guide, and weather cover, and the insulating assembly for electrically isolating the electrical contacts from one another until contact is desired.
Figure 5:
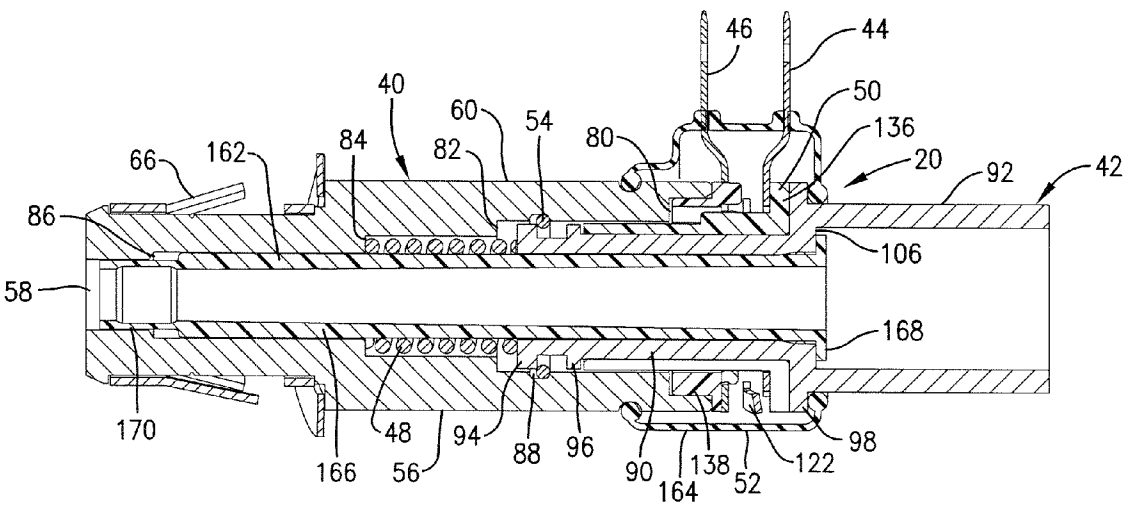
FIG. 5 is a vertical cross-sectional view taken along line 4-4 of FIG. 3, showing an internal seal extending axially through a central bore of the anchor fitting and an a passage of the conduit guide aligned with the central bore, and a biasing spring in an uncompressed condition with the electrical contacts electrically separated from one another.
Figure 6:
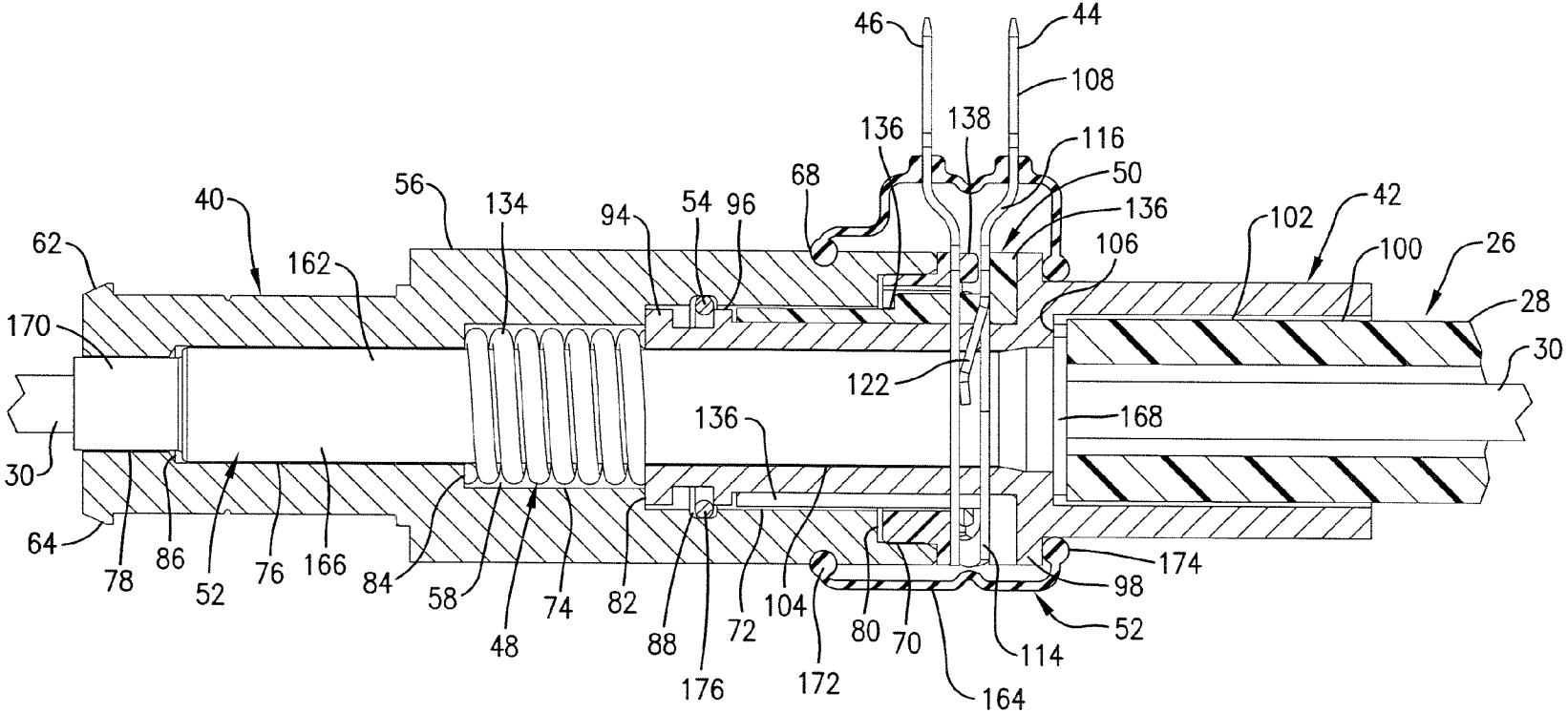
FIG. 6 is an enlarged vertical cross-sectional view similar to FIG. 4, but showing a control cable installed in the inline conduit switch and the electrical contacts shown in elevation, with the inner core of the control cable in tension causing the sheath to compress the biasing element to bring the electrical contacts together and form an electrical connection therebetween.
Figure 9:
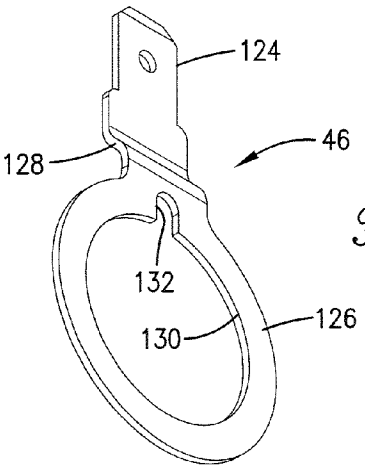
FIG. 9 is an isometric view of a second electrical contact of the inline conduit switch showing a second keyway in a ring portion of the contact for receiving the key of the insulator sleeve therethrough.

In greater detail, the anchor fitting 40 is a body 56 which is most preferably manufactured of a corrosion-resistant metal and includes an internal surface defining a central bore 58 extending axially through the body 56. The body 56 also has an external surface 60 which may be externally threaded for mounting a nut onto the tip 62 as shown in FIG. 13, or the tip 62 may include a flare 64 for receiving thereon and retaining a mounting clip 66 as shown in FIGS. 1-12. The external surface 60 also preferably includes a circumferentially extending external groove 68. The body 56 of the anchor fitting 40 is also preferably formed whereby the central bore 58 is stepped as shown in FIGS. 4, 5 and 6 such that proceeding axially from a first stage 70 of the central bore 58 oriented axially toward the conduit fitting 42 to a second stage 72, a third stage 74, a fourth stage 76 and finally to a fifth stage 78 most proximate the tip 62, each successive stage having a narrower diameter than the preceding one. As each stage transitions to the next stage, a narrowing shoulder is provided which extends radially inwardly. Thus, a first shoulder 80 extends radially inwardly from first stage 70 to second stage 72, a second shoulder 82 extends radially inwardly from second stage 72 to third stage 74, a third shoulder 84 extends radially inwardly from third stage 74 to fourth stage 76, and a fourth shoulder 86 extends radially inwardly from fourth stage 76 to fifth stage 78. Each of the first through fourth shoulders has a different function as will be described hereinafter. A circumferentially extending internal groove 88 is located in second stage 72 for receiving the retainer 54 when the inline conduit switch 20 is assembled.

The conduit fitting 42 is configured to include an elongated probe 90 which is received within the first stage 70 and second stage 72 of the central bore 58, and an enlarged receiver 92 into which the sheath 28 of the control cable 26 is received. The elongated probe 90 includes first and second axially spaced radially extending flanges 94 and 96, the axial spacing between the flanges 94 and 96 corresponding to the desired displacement of the conduit fitting 42 relative to the anchor fitting during reciprocal shifting of the conduit fitting 42. The flange 94 is sized and arranged to abut second shoulder 82 to provide a stop and limit the axial travel of the conduit fitting 42 relative to the anchor fitting 40. A rim 98 extends radially outwardly from the receiver 92 proximate the probe 90. The conduit fitting 42 includes a central passage 100 which, when the inline conduit switch 20 is assembled, is aligned with the central bore 58 of the anchor fitting 40. A first section 102 of the central passage 100 is located within the receiver 92 and has a diameter which is complemental to that of the sheath 28 in order to hold the sheath 28, most preferably by swaging the receiver 92 onto the sheath. The second section 104 of the central passage 100 is preferably narrower in diameter than the first section 102, providing an internal sleeve shoulder 106 extending radially inwardly from the first section 102 to the second section 104.

Figure 7:
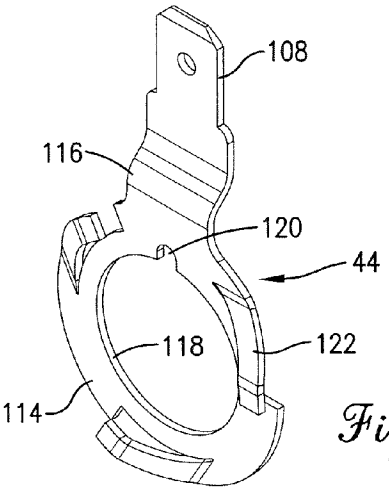
FIG. 7 is an isometric view of a first electrical contact of the inline conduit switch showing a first keyway in a central opening of an annular body which includes a plurality of circumferentially extending leaf spring contact prongs.
Figure 11:
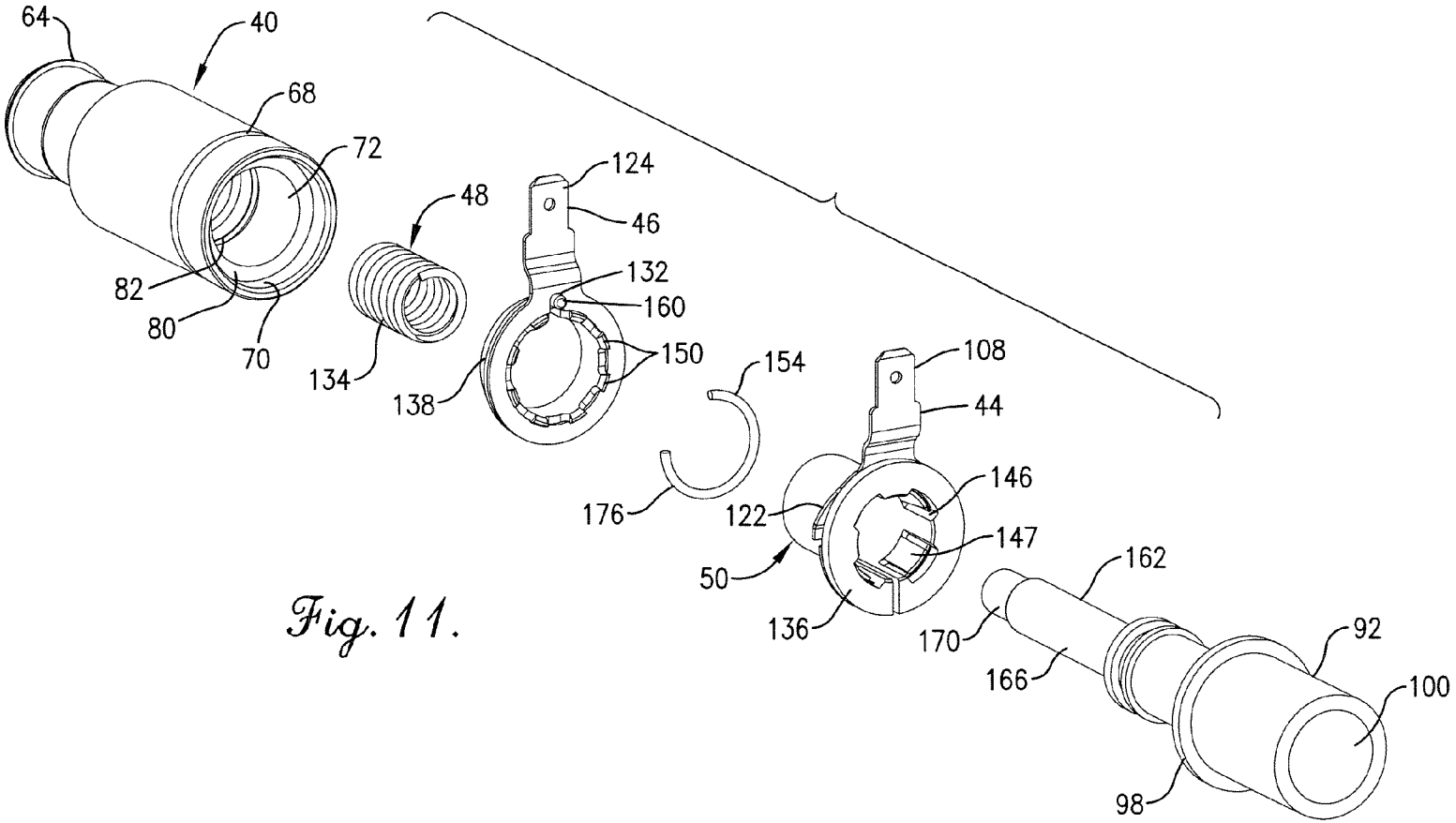
FIG. 11 is an exploded isometric view of the inline conduit switch hereof with the weather cover removed and without the control cable installed, taken from the conduit guide looking toward the anchor fitting to shown the alignment of the internal seal received in the conduit fitting with the biasing spring and the anchor fitting, with the insulator sleeve and the insulator guide mounting respective first and second electrical contacts.
Figures 12, 13:
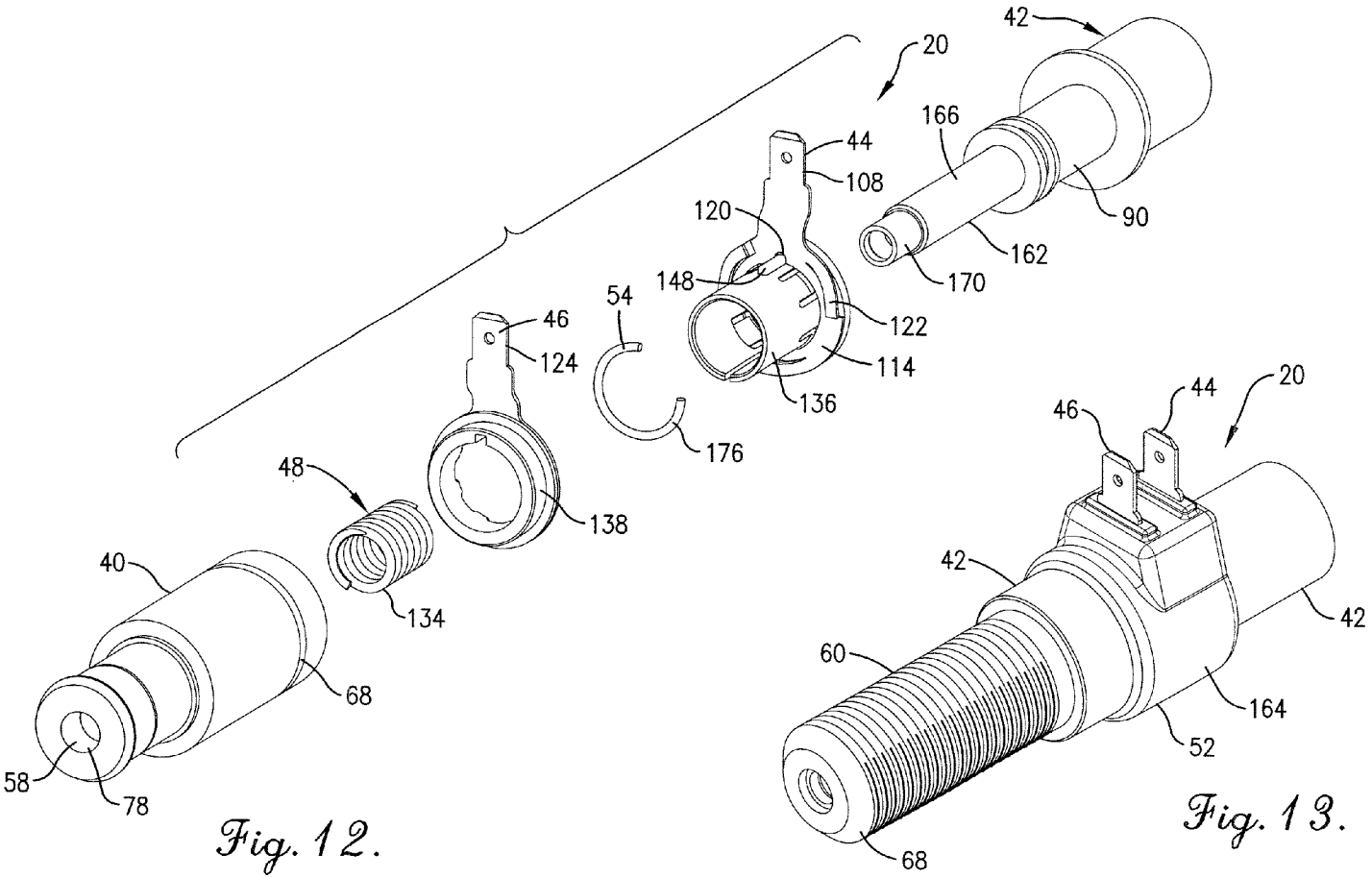
FIG. 12 is an exploded isometric view of the inline conduit switch hereof similar to FIG. 11 but taken from the anchor fitting looking toward the conduit guide.
FIG. 13 is an isometric view showing an inline conduits switch similar to that shown in FIGS. 1-12, but wherein the anchor fitting is provided with a threaded neck for receiving a nut replacing the snap-in mounting clip for attachment to a support.

The first electrical contact 44 is shown positioned in the assembled inline conduit switch 20 in FIGS. 4, 5 and 6, and in an exploded view of the switch 20 in FIGS. 11 and 12. FIG. 7 illustrates the configuration of the first electrical contact 44 alone which is shown as a unitary member, wherein a first ear 108 for receiving thereon a terminal 110 attached to a wire 112 as shown in FIG. 1 is connected to a first annular body 114 by a first offset transition 116. The annular body 114 includes a generally circular first central opening 118 having a first keyway 120 therein. The first annular body 114 preferably includes a plurality of circumferentially spaced leaf spring prongs 122 which are unitary with the first annular body 114 and extend therefrom axially to provide yieldable electrical contact surfaces with the second electrical contact 46 when the guide fitting 42 is shifted toward the anchor fitting 40. The first keyway 120 is preferably but not necessarily substantially radially aligned with the ear 108.

The second electrical contact 46 is configured similar to the first electrical contact but without the leaf spring prongs. That is, the second electrical contact includes a second ear 124 which is connected to and projects radially from a second annular body 126 by a second offset transition 128. The second annular body 126 has a generally circular second central opening 130 which in the embodiment illustrated is greater in diameter than the diameter of the first central opening 118 of the first electrical contact 44. A second keyway 132 is provided in the second central opening and is preferably, but not necessarily, radially aligned with the second ear 124.

The biasing member 48 is preferably provided as a coil spring 134 positioned axially between the anchor fitting 40 and the conduit fitting 42 as shown in FIGS. 4, 5, 6, 11 and 12. The coil spring 134 engages the third shoulder 84 and the second flange 94.

Figure 10:
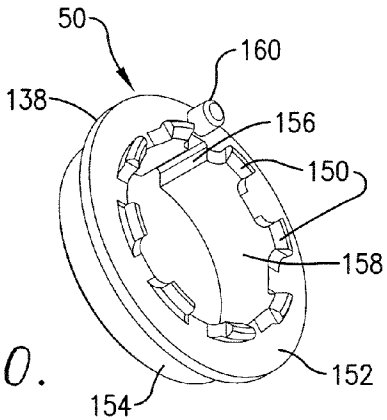
FIG. 10 is an isometric view of an insulator guide of the insulating assembly of the inline conduit switch, showing a key slot to be aligned with the key of the insulator sleeve.
Figure 8:
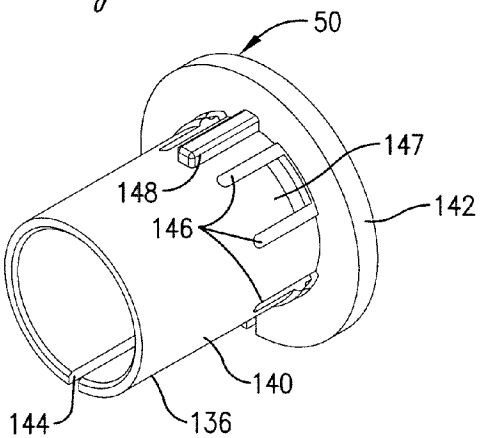
FIG. 8 is an isometric view of an insulator sleeve of the insulating assembly of the inline conduit switch, showing a cylindrical shaped hub and a annular disc unitary with the hub and extending radially therefrom, and a key extending axially from the disc along the outer surface of the hub.

The insulating assembly 50 includes an insulator sleeve 136 shown separately in FIG. 8 and an insulator guide 138 shown separately in FIG. 10. Both the insulator sleeve 136 and the insulator guide 138 are molded of electrically non-conductive material, preferably a synthetic resin material with friction resistant properties such as high density polyethylene, nylon, or most preferably delrin. The insulator sleeve 136 is tubular and provided with a generally cylindrical neck 140 and a radially projecting rim 142. The neck 140 and rim 142 are provided with an expansion slot 144 which permits the insulator sleeve to expand and slide over the first and second flanges 94 and 96 for positioning over the probe 90 of the conduit fitting 42 with the rim 142 abutting the rim 98 of the conduit fitting 42. The neck 140 is provided with a plurality of axially extending circumferentially spaced slots 146 with the portions of the neck 140 between the slots 146 alternating between those portions connected to the rim 142 and those separated from the rim by a circumferential partial gap providing fingers 147 for retaining the first electrical contact 44 thereon, the fingers 147 being sized for frictional engagement with the first annular body 114 so that the neck 140 extends through the first central opening 118 while at the same time not interfering with the leaf spring prongs 122. The neck 140 is also provided with a key 148 which projects radially outwardly beyond the fingers 147 of the neck 140 for passage through the first keyway 120. The radially projecting rim 142 and the neck 140 of the insulator sleeve 136 thus electrically insulates the first electrical contact 44 from the conduit fitting 42.

The insulator guide 138 is generally annular having a plurality of axially extending, circumferentially spaced fingers 150 which are yieldable to permit installation of the second annular body 126 of the second electrical contact 46 thereon. The fingers 150 project axially from a generally circular flange 152. A hub 154 extends from the circular flange opposite the fingers 150. The circular flange 152 and the hub 154 are sized and provided with an internal diameter sufficient to permit the insulator guide to slide over the neck 140 of the insulator sleeve 136, and an inner slot 156 extends axially along the inner surface 158 of the circular flange 152 and hub 154 to slidably receive the key 148 therein. A nub 160 is spaced radially outwardly of the fingers 150 and projects axially in the same direction as the fingers, the nub 160 being preferably radially aligned with the inner slot 156. The insulator guide 138 is preferably configured whereby the nub 160 is positioned to be received in the second keyway 132 for substantially preventing rotational movement of the second electrical contact 46 relative to the insulator guide 138. Additionally, the insulator guide 138 is sized whereby the hub 154 is inserted into the first stage 70 of the central bore 58 with the circular flange 152 axially positioned between the second electrical contact 46 and the anchor fitting 40 whereby the second electrical contact 46 is electrically insulated from the anchor fitting 40 by the hub 154 and the circular flange 152.

The sealing assembly 52 generally includes an elongated tubular internal seal 162 and a weather cover 164. The internal seal 162 is sized and configured to be inserted into the receiver 92 of the conduit fitting 42 and extend axially along the passage 100. The internal seal is tubular, and is preferably molded of an elastomeric material such as natural or synthetic rubber. The internal seal 162 is designed to surround the inner core 30 passing through the anchor fitting 40 and the conduit fitting 42 and includes an elongated tubular body 166 and a radially extending disc-shaped flap 168 molded therewith. The flap 168 is sized and configured to fit against the sheath 28 when inserted into the receiver 92 and also against the internal sleeve shoulder 106. The elongated tubular body 166 seals against the fourth stage of the central bore 58 but is slidable therealong, and has a narrowed nose 170 at the end opposite the circular flap 168 in order that the nose 170 may fit into the narrowmost fifth stage 78 of the central bore 58 of the anchor fitting 40.

The sealing assembly 52 also includes a weather cover 164 which acts as a surrounding boot around the junction between the anchor fitting 40 and the conduit fitting 42. The weather cover 164 is provided with slits through which the first ear and second ear project, as shown in FIGS. 2 and 3, and is made of elastomeric material such as natural or synthetic rubber to remain flexible for installation in a position to surround the annular bodies of the electrical contacts 44 and 46 and during repeated cycles or reciprocal shifting of the conduit fitting 42 relative to the anchor fitting 40, and to seal tightly against the conduit fitting 42 and the anchor fitting 40 as shown in the drawings. In this way, a first edge 172 of the weather cover 164 is received in the external groove 68 of the anchor fitting 40, and a second edge 174 seals against the outer surface of the rim 98 of the conduit fitting 42.

The retainer 54 is provided as a snap ring 176 which is positioned over the probe 90 between the first and second flanges 94 and 96 prior to insertion of the probe 90 into the central bore 58. The snap ring 176 is compressed prior to insertion of the probe 90 into the central bore 58, and once the snap ring 176 moves axially into position adjacent the internal groove 88, the snap ring 176 expands, thereby retaining the conduit fitting 42 in engagement with the anchor fitting 40 but permitting limited relative axial movement therebetween.

The inline conduit switch 20 is assembled by inserting the internal seal 162 into the receiver of the conduit guide 42, installing the first electrical contact 44 over the insulator sleeve 136, installing the second electrical contact 46 over the insulator guide 138, and then sliding the insulator guide 138 over the insulator sleeve 136 so that the ears are aligned and the key 148 is aligned with or partially received into inner slot 156. The spring 134 is then positioned over the tubular body 166, and the snap ring 176 is positioned between the flanges 94 and 96. The snap ring 176 is compressed and the probe 90 is inserted into the central bore 58. When the snap ring 176 reaches the groove 88, it expands and locks the conduit guide 42 into axially shiftable position with anchor fitting 40. The weather cover 164 is then installed by sliding the weather cover 164 axially over the anchor fitting 40 and the conduit fitting 42 and positioning the ears of the electrical contacts 44 and 46 into the slits provided in the weather cover. The control cable 26, and more particularly the sheath 28, is then attached to the receiver of the conduit fitting 42, preferably by swaging, with the proximate end of the inner core 30 extending out of the central bore 58 beyond the tip 62, and attached to the lever (or other control element) of the control assembly 24. The remote end of the inner core 30, not shown, is then attached to the device (e.g., a brake, flap or the like) to be controlled. The inline conduit switch 20 is then mounted to the support 22 by insertion of the clip 66 into an opening as shown in FIG. 1, or using a nut threaded onto the outer surface when the latter is threaded as shown in FIG. 13.

In use, the operator actuates the inner core 30 of the control cable 26 by pivoting the lever 32 or actuating a similar device. This places the inner core 30 in tension and, at the same time, causes the sheath 28 to be in compression. The compression force acts on the conduit fitting 42, causing the conduit fitting to shift axially to the left as shown in FIGS. 4, 5 and 6. This compresses the spring 134, and brings the electrical contacts 44 and 46 together until the leaf spring contacts 122 of the first electrical contact 44 engage the annular body 126 of the second electrical contact 46. Notwithstanding relative rotation between the conduit fitting 42 and the anchor fitting 40 caused by normal operation or repair, the electrical contacts 44 and 46 remain in alignment because of the key 148 being received within the internal slot 156. The flange 94 engages the second shoulder 82 to provide a limit on the travel of the conduit fitting 42 within the anchor fitting 40. This not only prevents overloading of the spring 134, but also prevents overloading of the leaf spring contacts 122 so that they are not deformed and retain their resiliency. A further safeguard against overloading (for example, if the probe 90 was made shorter in length so that the flange 94 did not engage the second shoulder 82 as described above) is provided by the snap ring 176 which engages the flange 96 when the limit of closure (shown in FIG. 6) is reached. This brings the electrical contacts 44 and 46 in to electrical contact, closes the circuit, and permits current to flow between wires 112 when the contacts 44 and 46 are closed. The internal seal 162 prevents mud and moisture from entering through the central bore 58 or through the opening into the receiver from reaching the electrical contacts. The weather cover 164 is flexible through repeated reciprocating cycles, and surrounds the annular bodies of the electrical contacts 44 and 46 to prevent the entry of mud or moisture therein.

What is claimed is:

1. An inline conduit switch comprising:

an outer member having an axially-extending bore therethrough, wherein the outer member includes an internal annular groove in the axially-extending bore to at least partially house a retainer therein;

an inner member at least partially received within the axially-extending bore and slidable along at least a portion of the axially-extending bore between a first configuration and a second configuration with respect to the outer member, wherein the inner member includes first and second flanges extending radially therefrom and defining an annular groove therebetween to secure the retainer therein and limit axial movement of the inner member relative to the outer member;

an electrical member operatively positioned intermediate said outer and inner members and oriented in an open, non-electrically conductive configuration when the inner member is in the first configuration and oriented in a closed, electrically conductive configuration when the inner member is in the second configuration; and a biasing member within the axially-extending bore to apply an axially-directed force between the outer member and the inner member that biases the inner member to the first configuration.

2. The inline conduit switch according to claim 1, wherein the electrical member includes first and second electrical contacts extending lateral to the axially-extending bore, the first electrical contact having a resilient member extending therefrom that (i) is spaced from the second electrical contact when the inner member is in the first configuration, and (ii) abuts the second electrical contact when the inner member is in the second configuration.

3. The inline conduit switch according to claim 1, wherein the inner member includes (i) a probe member located on a first end of the inner member that extends into the axially-extending bore of the outer member, (ii) an enlarged receiver on a second end of the inner member, and (iii) a radially-extending shoulder spacing the probe member from the enlarged receiver.

4. The inline conduit switch according to claim 1, wherein the retainer abuts (i) the first flange when the inner member is in the second configuration and (ii) the second flange when the inner member is in the first configuration.

5. The inline conduit switch according to claim 1, wherein the outer member includes (i) a first inner abutment surface along the axially-extending bore to abut the biasing member, and (ii) a second inner abutment surface along the axially-extending bore to abut the second flange of the inner member when the inner member is in the second configuration.

6. The inline conduit switch according to claim 1, further comprising an insulator encapsulating a junction region between the inner member and outer member.

7. An inline conduit switch comprising:

an outer member having an axially-extending bore therethrough;

an inner member at least partially received within the axially-extending bore and slidable along at least a portion of the axially-extending bore between a first configuration and a second configuration with respect to the outer member, wherein the inner member includes (i) a probe member located on a first end of the inner member that extends into the axially-extending bore of the outer member, (ii) an enlarged receiver on a second end of the inner member, and (iii) a radially-extending shoulder spacing the probe member from the enlarged receiver;

an electrical member operatively positioned intermediate said outer and inner members and oriented in an open, non-electrically conductive configuration when the inner member is in the first configuration and oriented in a closed, electrically conductive configuration when the inner member is in the second configuration; and a biasing member within the axially-extending bore to apply an axially-directed force between the outer member and the inner member that biases the inner member to the first configuration, wherein the probe member includes a narrowed tip extending partially out of the axially-extending bore when the inner member is in the second configuration.

8. An inline conduit switch comprising:

an axially-compressible body including an anchor fitting configured for mounting to a support and a conduit fitting configured for mounting a control cable thereto, said anchor fitting being coupled to said conduit fitting for relative axial movement therebetween from a first configuration to a second configuration when the body is subjected to an external axial force, wherein said anchor fitting includes an internal surface defining an axially extending substantially cylindrical bore; and a first electrical contact and a second electrical contact extending into the body, the first electrical contact having a resilient member that abuts the second electrical contact at an abutment region when the body is in the second configuration, wherein said conduit fitting further includes first and second axially spaced radially extending flanges and said anchor fitting has a circumferentially extending internal groove, said first radially extending flange being positioned more proximate said internal groove when said body is in said first configuration, and said second radially extending flange being positioned more proximate said internal groove when said body is in said second configuration.

9. The inline conduit switch according to claim 8, further comprising a biasing member configured and operatively connected to the body to bias the body to the first configuration.

10. The inline conduit switch according to claim 8, wherein said axially extending bore includes at least one shoulder within the bore operable to limit axially shiftable movement between said conduit fitting and said anchor fitting and corresponding compression of the body.

11. The inline conduit switch according to claim 8, further comprising a retainer disposed between said first and second radially extending flanges at least partially within the groove for limiting relative axial movement between the anchor fitting and the conduit fitting of the body.

12. The inline conduit switch according to claim 11, wherein the retainer is configured and positioned to abut said first radially extending flange when the body is in the first configuration and to abut said second radially extending flange when the body is in the second configuration.

13. The inline conduit switch according to claim 8, further including an insulator substantially encapsulating the abutment region and an adjacent portion of the anchor fitting and the conduit fitting in both the first configuration and the second configuration of the body.

14. An inline conduit switch comprising:

an axially-compressible body including an anchor fitting configured for mounting to a support and a conduit fitting configured for mounting a control cable thereto, said anchor fitting being coupled to said conduit fitting for relative axial movement therebetween from a first configuration to a second configuration when the body is subjected to an external axial force, wherein said anchor fitting includes an internal surface defining an axially extending substantially cylindrical bore; and a first electrical contact and a second electrical contact extending into the body, the first electrical contact having a resilient member that abuts the second electrical contact at an abutment region when the body is in the second configuration, wherein the conduit fitting of the body has an interior probe within the bore that is substantially entirely concealed by the anchor fitting of the body when the body is in the first configuration and wherein said interior probe is at least partially exposed from the bore when the body is in the second configuration.

* * * * *